US010105736B2

(12) United States Patent
Raus

(10) Patent No.: US 10,105,736 B2
(45) Date of Patent: Oct. 23, 2018

(54) SEPARATOR WITH A BYPASS

(71) Applicants: ThyssenKrupp Industrial Solutions AG, Essen (DE); ThyssenKrupp AG, Essen (DE)

(72) Inventor: Matthias Raus, Münster (DE)

(73) Assignees: THYSSENKRUPP INDUSTRIAL SOLUTIONS AG, Essen (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 15/115,748

(22) PCT Filed: Jan. 30, 2015

(86) PCT No.: PCT/EP2015/000180
§ 371 (c)(1),
(2) Date: Aug. 1, 2016

(87) PCT Pub. No.: WO2015/113769
PCT Pub. Date: Aug. 6, 2015

(65) Prior Publication Data

US 2017/0008034 A1 Jan. 12, 2017

(30) Foreign Application Priority Data

Jan. 31, 2014 (DE) ..... 10 2014 101 188

(51) Int. Cl.
*B07B 9/02* (2006.01)
*B07B 4/02* (2006.01)
(Continued)

(52) U.S. Cl.
CPC ..... *B07B 9/02* (2013.01); *B07B 4/02* (2013.01); *B07B 7/083* (2013.01); *B02C 13/14* (2013.01)

(58) Field of Classification Search
CPC .... B07B 4/02; B07B 4/08; B07B 7/08; B07B 7/083; B07B 9/02; B02C 13/14
(Continued)

(56) References Cited

U.S. PATENT DOCUMENTS 1,977,479 A 10/1934 Hebley et al.
2,694,492 A * 11/1954 Rumpf et al. ..... B07B 7/083 209/147

(Continued)

FOREIGN PATENT DOCUMENTS

CA 2400859 A1 12/2000
DE 2456970 C3 6/1976

(Continued)

OTHER PUBLICATIONS

International Search Report for PCT/EP2015/000180 dated May 4, 2015 (dated May 18, 2015).

(Continued)

*Primary Examiner* — Joseph C Rodriguez
*Assistant Examiner* — Kalyanavenkateshware Kumar
(74) *Attorney, Agent, or Firm* — thyssenkrupp North America, Inc.

(57) ABSTRACT

A separator may include a housing with a separation space in which a ventilation base is disposed and in which separation stock is perfusable by separation gas so as to separate fine stock from coarse stock. A separation-gas inlet and a separation-stock inlet may open into the separation space, and a fine-stock outlet and a coarse-stock outlet may lead out of the separation space. A bypass duct may be integrated in the housing for bypassing the separation space. The bypass duct may lead out of the separation-gas inlet and open out downstream of the separation space.

18 Claims, 9 Drawing Sheets

(51) Int. Cl.
*B07B 7/083* (2006.01)
*B02C 13/14* (2006.01)

(58) Field of Classification Search
USPC ..... 209/138, 145, 710, 714, 718
See application file for complete search history.

(56) References Cited

U.S. PATENT DOCUMENTS

| | | | | |
|---|---|---|---|---|
| 3,398,829 | A * | 8/1968 | Brown | B07B 7/01 209/140 |
| 4,071,441 | A | 1/1978 | Schauer | |
| 8,770,411 | B2 * | 7/2014 | Winkhardt | B07B 4/00 209/138 |
| 9,586,365 | B2 * | 3/2017 | Chen | B07B 4/00 |
| 2008/0087583 | A1 * | 4/2008 | Van de Laak | A24B 1/04 209/577 |
| 2013/0032513 | A1 | 2/2013 | Linnhoff | |

FOREIGN PATENT DOCUMENTS

| | | | |
|---|---|---|---|
| DE | 4337215 | A1 | 5/1995 |
| DE | 102004027128 | A | 12/2005 |
| DE | 102011055762 | A1 | 5/2013 |

OTHER PUBLICATIONS

English Language Abstract for DE4337215.
English Language Abstract for DE102011055762.
English abstract for DE102004027128.

* cited by examiner

SEPARATOR WITH A BYPASS

CROSS REFERENCE TO RELATED APPLICATIONS

This application is a U.S. National Stage Entry of International Patent Application Serial Number PCT/EP2015/000180, filed Jan. 30, 2015, which claims priority to German Patent Application No. DE 10 2014 101 188.0 filed Jan. 31, 2014, the entire contents of both of which are incorporated herein by reference.

FIELD

The present disclosure relates to static-operation separators for separating fine stock from coarse stock.

BACKGROUND

Static-operation separators separate bulk materials into two fractions having dissimilar distributions of particle sizes. Separating the fractions is performed in a separation space in which the separation stock, falling in from a separation-stock inlet in the direction of a coarse-stock outlet, is perfused in the transverse direction by a separation gas. Comparatively small particles are entrained by the separation-gas flow and transported to a fine-stock outlet, while comparatively large particles are discharged by way of the coarse-stock outlet.

The ventilation bases of a static separator are aligned so as to be more or less transverse to the movement direction of the separation stock, a step-type arrangement of the ventilation bases often being provided (DE 43 37 215 A1). According to one preferred embodiment, a ventilation base which is configured so as to be substantially planar is provided with a multiplicity of ventilation slots. The ventilation base here may be assembled from a multiplicity of individually replaceable slotted plates. The separation stock falling into the separation space impacts the ventilation base(s) and is perfused there by the separation gas. The dwelling time of the separation stock in the separation space may be increased by the separation stock impacting the ventilation base(s), on the one hand. On the other hand, the separation stock impacting on the ventilation bases causes separation-stock agglomerates, so-called slugs, which are often present to disagglomerate. Both lead to the separation effect of a static separator being enhanced.

Static separators are often combined with dynamic separators, the static separators, as coarse separator, typically being upstream of the dynamic separator which serves as a fine separator. Dynamic separators operate on the basis of separating two fractions of the separation stock which are dissimilar in terms of the distribution of the particle sizes by means of a rotatingly driven separation cage.

A combination of a static separator as a coarse separator, and of a dynamic separator as fine separator in a recirculating grinding mill for cement clinker is known from DE 43 37 215 A1, for example. The static separator therein is downstream of a roller press and is impinged by the latter with separation stock which is comparatively coarse and has a multiplicity of slugs. The coarse stock which has been separated in the static separator is fed back to the roller press, while the fine stock by means of the separation gas flow is infed to a tubular ball mill in which said fine stock is further comminuted. From the tubular ball mill, the separation stock is then infed to the dynamic separator in which a separation of the separation stock into medium-fine stock and finest stock is performed. The finest stock as finished stock is then eliminated from the separation gas in a sorter, while the medium-fine stock is fed back to the tubular ball mill. In the case of the recirculating grinding mill according to DE 43 37 215 A1, the static separator and the dynamic separator are kept apart in terms of both space and function by the interdisposed tubular ball mill. The static separator thus serves substantially for avoiding excessively large particles or slugs being infed to the tubular ball mill.

A device for separating bulk material, in which a static separator and a dynamic separator are disposed in direct succession and integrated in a common housing, thus being perfused by the same separation-gas flow, is known from DE 10 2011 055 762 A1. The upstream disposal of the static separator serves substantially for avoiding impingement of the rotatingly driven and comparatively delicate separation cage of the dynamic separator by large particles and slugs.

It is also disclosed in DE 10 2011 055 761 A1 that, in addition to a main separation-gas inlet for a static separator, additional openings which by means of flaps or slides may be embodied so as to be closable may be provided, on account of which regulation of the separation gas which is infed to the static separator is to be enabled.

Finally, a dynamic separator in the housing of which a bypass duct which bypasses the separation space is integrated is known from DE 42 56 970 C3, by way of which bypass duct part of the dust-air mixture which is infed by way of an inlet may be directed so as to avoid separation in the separation space. On account thereof, targeted influencing of the particle sizes in the finished stock leaving the dynamic separator is to be possible.

DETAILED DESCRIPTION

Figure 1:
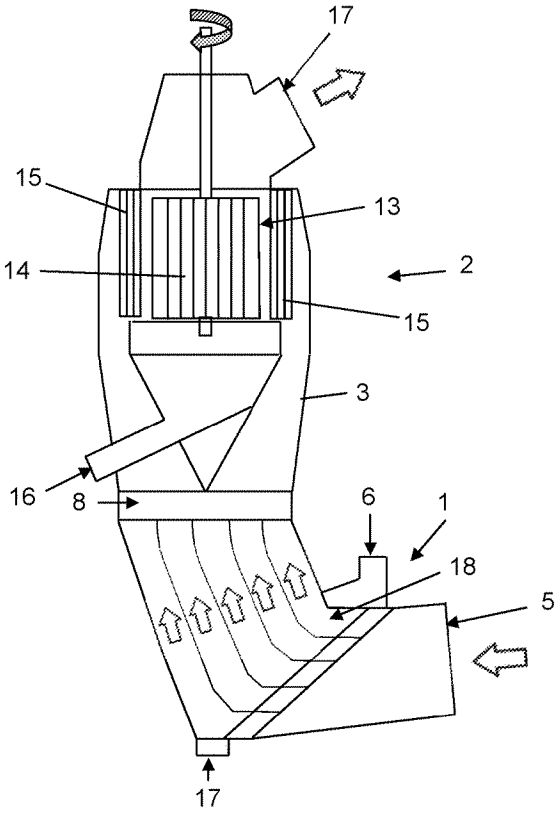
FIG. 1 is a side schematic view of an example separator with an example static coarse separator and an example dynamic fine separator.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The present disclosure is based at least in part on the object of performing the separation effect of a static separator so as to be variable in as simple a manner as possible. In some examples, a separator may have a housing that configures a separation space in which one or a plurality of ventilation bases are disposed and in which separation stock is perfused by separation gas so as to separate fine stock from coarse stock. A separation-gas inlet and a separation-stock inlet may open into the separation space, and a fine-stock outlet and a coarse-stock outlet may lead out of the separation space.

The present disclosure is based at least in part on the concept that the volumetric flow of the separation gas being directed through the static separator represents an easy-to-influence control variable, the modification of which having a relevant effect on the separation effect of the separator. In particular, an adaptation of the distributions of the particle sizes of the material which is discharged from the static separator as fine stock, on the one hand, and as coarse stock, on the other hand, may be performed by modification of the volumetric flow of the separation gas. This may be performed, in particular, depending on the apparatuses (for example, a mill or a dynamic separator), which are downstream of the static separator. A modification of the drying effect of the (optionally heated) separation gas may also be achieved by adapting the volumetric flow.

By correspondingly actuating a blower which generates the separation-gas flow, the volumetric flow of the separation gas herein could in principle be set to the envisaged separation effect. However, it is disadvantageous here that the volumetric flow of the separation gas for an apparatus which is downstream of the static separator, in particular a dynamic separator, is also modified on account thereof.

In order for this potential disadvantage to be avoided it is provided according to the invention for the volumetric flow of the separation gas which is infed to the static separator, which preferably may be air, to be embodied in a variable manner in that at least one bypass duct, by way of which part of the separation-gas flow bypasses the separation space, is provided.

Accordingly, a static separator of the generic type, having at least one housing in which the separation space is located, in which one or a plurality of ventilation bases are disposed and in which separation stock is perfused by separation gas so as to separate the separation stock into fine stock and coarse stock, wherein (at least) one separation-gas inlet and (at least) one separation-stock outlet open into the separation space, and (at least) one fine-stock outlet and (at least) one coarse-stock outlet lead out of the separation space, according to the invention is characterized by at least one bypass duct, integrated in the housing, for bypassing the separation space, wherein the bypass duct leads out of the separation-gas inlet and opens out downstream of the separation space.

A separation space is understood to be in particular that region of the separator in which material separation, that is to say sorting out of a material of a specific grain size is performed. The material of a comparatively coarse grain size exits the separation space by way of the coarse-stock outlet, the material of comparatively fine grain size entering the fine-stock outlet. The fine-stock outlet is downstream of the separation space and is configured in such a manner that no material separation is performed therein.

The bypass duct opens into the separator downstream of the separation space, wherein the bypass duct into the fine-stock outlet, for example, or into a gas entry point of a second and in particular dynamic separator which is downstream of the first separator.

Herein, a bypass duct integrated in the housing is understood in particular to be at least one wall face (preferably all wall faces) which delimits (delimit) the bypass duct and which preferably runs (run) along the entire length of the bypass duct, is (are) part of the housing and, apart from functioning as a delimitation of the bypass duct, is (are) used in structural terms (as a supporting wall) or in functional terms (for example for directing a medium) for other parts of the separator.

By integrating the at least one bypass duct in the housing of the separator one or a plurality of advantages may be generated as compared with an externally routed bypass duct which may be configured in the form of a bypass hose, for example. In particular, a smaller space requirement, better accessibility of maintenance and inspection openings, simplified packaging and transportation of the separator, and/or less investment in assembling may be achieved. Compensators which may be required in the case of an externally routed bypass duct for equalizing dissimilar thermal expansions may also be dispensed with in the case of a bypass duct integrated in the housing.

In one preferred design embodiment of the separator according to the invention it may be provided that said separator has one static coarse separator and one fine separator, downstream of said coarse separator, integrated in one housing. Accordingly, it may be provided that a second, in particular dynamic, separator having a second separation space adjoins the fine-stock outlet, wherein a housing which configures the second separator and which surrounds the second separation space configures a medium-fine stock outlet and a finest-stock outlet, which may also be referred to as a 'most-fine stock outlet.' Herein, it may be provided in particular that the fine separator is a dynamic fine separator which accordingly comprises a rotatingly drivable separation rotor, for example in the form of a conventional separation cage, which is disposed in the second separation space. Such a separator which comprises a static coarse separator and a fine separator downstream thereof may be preferably utilized in combination with (at least) one blower for generating the separation-gas flow which is utilized by both (part-)separators.

The capability of influencing the volumetric flow of the separation gas which is directed through the static coarse separator by way of the bypass duct in the case of such a combination with a fine separator has advantages in particular since in this manner the volumetric flow through the static coarse separator may be implemented in a regulatable manner so as to be largely independent of the volumetric flow through the fine separator. It may be provided in particular that the total volumetric flow of the separation gas which is infed to the separator by way of the separation-gas inlet is planned with a view to the volumetric flow requirement of the fine separator, and the typically lesser volumetric flow requirement of the coarse separator is adapted by redirecting a more or less large part of the total volumetric flow past the (first) separation space of the coarse separator.

In order for the capability of regulating the volumetric flow of the separation gas that is directed by way of the coarse separator to be kept as variable as possible, a regulator element by means of which the available flow cross section of the bypass duct may be (manually or automatically) modified may be provided. The regulator element may be embodied as a regulator flap or as a regulator slide, for example, which is adjustable by means of an actuator.

Furthermore preferably, it may be provided that the bypass duct configures a plurality of flow ducts (which are kept apart in spatial terms). On account thereof, a more uniform distribution of the flow of the separation gas which is directed by way of the bypass duct and, on account thereof, also a more uniform introduction into the main flow of the separation gas in the fine-stock outlet may be achieved.

In the case of such a design embodiment of the bypass duct it may then also be provided in order for the part-flows of the separation gas that are directed by way of the individual flow ducts to be homogenized that one regulator element is provided for each of a plurality and in particular for each of all of the flow ducts. It may also be provided here that the regulator elements are individually adjustable.

In a furthermore preferred design embodiment of the separator according to the invention it may be provided that the flow ducts terminate in the fine-stock outlet at a spacing from the port of the bypass duct. On account thereof, the part-flows which are directed by way of the flow ducts are re-unified even before entering the fine-stock outlet and thus even prior to being mixed with the main flow of the separation gas. This may have a positive effect with a view to as uniform as possible an introduction of the part-flows which are directed by way of the bypass duct into the main flow.

Unification of the part-flows of the separation gas which are directed by way of the flow ducts may be particularly advantageous when the separation-gas flow which is directed by way of the bypass duct is introduced into the fine-stock outlet by way of a port opening which is comparatively small in comparison to the cross-sectional dimensions of the fine-stock outlet in the region of the port of the bypass duct. Herein, it may be particularly preferably provided that the bypass duct opens into the fine-stock outlet in a decentralized manner, on account of which the again mixed total flow of the separation gas may be imparted a swirl by means of the separation-gas flow which enters from the bypass duct into the fine-stock outlet which may have a positive effect in particular on the separation effect of a dynamic fine separator which is downstream of the static coarse separator. Herein, it may preferably be provided that the rotation direction of the swirl of the separation-gas flow corresponds to the rotation direction of the separation rotor of the dynamic fine separator.

"Decentralized" herein is understood to mean that the (mean) flow direction of the separation-gas flow entering from the bypass duct into the fine-stock outlet (and in particular the longitudinal central axis of the port opening) does not intersect the longitudinal central axis of the cross-sectional faces of the fine-stock outlet in the region of the port of the bypass duct. It may be provided in particular that the separation-gas flow entering from the bypass duct into the fine-stock outlet is introduced as far as possible from the longitudinal central axis and thus as close as possible to a wall of the housing that delimits the fine-stock outlet.

In as far as the separator according to the invention has at least two bypass ducts which may preferably be disposed on opposite sides of the first separation space, it may be provided for an increased swirl effect of the separation-gas flows entering from the two bypass ducts into the fine-stock outlet that each of these two bypass ducts does not only open into the fine-stock outlet in a decentralized manner but also mutually diametrically in relation to a longitudinal central axis of the fine-stock outlet.

In one furthermore preferred design embodiment of the separator according to the invention at least one intermediate wall which is disposed in the fine-stock outlet so as to be aligned transversely to the ventilation base(s) may be provided. The intermediate wall may have the effect of reinforcing the housing, on the one hand. On the other hand, an increase of the loading capacity of the main flow as a result of an increase in the Froude number may be achieved by the at least one intermediate wall which subdivides the flow space which is configured by the fine-stock outlet for the main flow of the separation gas into a plurality of part-flow spaces. This may be relevant in particular in the case of the design embodiment of a separator according to the invention in which part of the total volumetric flow of the separation gas which is infed by way of the separation-gas inlet is to be directed past the (first) flow space as required by means of the bypass duct(s).

In order for the intermediate wall to as far as possible not impede the introduction of the separation-gas flow which is directed by way of the at least one bypass duct it may be preferably provided that the bypass duct opens into the fine-stock outlet downstream of the intermediate wall.

In order to avoid as far as possible that diverting part of the volumetric flow of the separation gas from the main flow has a negative effect on the perfusion of the ventilation base(s) it may furthermore preferably be provided that the bypass duct leads out of the separation-gas inlet at (as large as possible) a spacing from the ventilation base(s). In terms of construction this may be implemented simply in that a partition wall which extends the bypass duct into the separation-gas inlet is provided.

The separator illustrated in FIG. 1 comprises a static coarse separator 1 and a dynamic fine separator 2 which is directly downstream thereof. The latter are both integrated in one (multi-part) housing 3, representing one functional unit.

Figure 3:
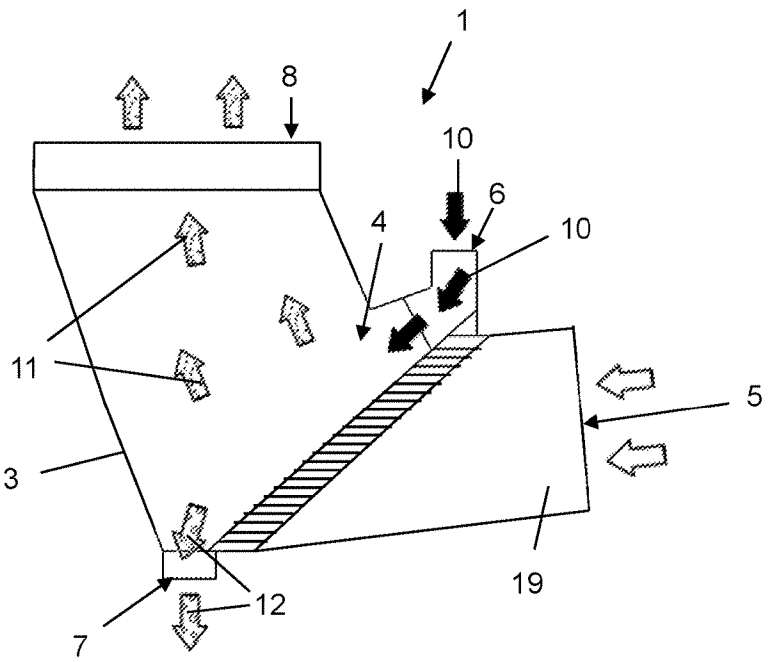
FIG. 3 is a sectional view taken across line III-III of the static coarse separator of FIG. 2.

The (part-) housing 3 of the static coarse separator 1 configures a (first) separation space 4, a separation-gas inlet 5, a separation-stock inlet 6, a coarse-stock outlet 7, and a fine-stock outlet 8. A ventilation base 9 which is aligned obliquely to the vertical and which has a multiplicity of ventilation slots (cf. FIG. 3) is provided in the first separation space 4. The ventilation base configures a guide plane which connects the separation-stock inlet 6 to the coarse-stock outlet 7. Separation stock 10 which is introduced into the first separation space 4 by way of the separation-stock inlet 6 is directed by gravity along this guide plane to the coarse-stock outlet 7 and is at the same time perfused by separation gas which flows through the ventilation slots of the ventilation base 9. The separation gas hereby entrains sufficiently small and thus light particles of the separation stock 10, that is to say the fine stock 11. The fine stock 11 together with the separation-gas flow is delivered to the fine-stock outlet 8 and from there infed to the downstream dynamic fine separator 2. That part of the separation stock 10 that has not been entrained, that is to say the coarse stock 12, is discharged by way of the coarse-stock outlet 7.

The fine stock 11 by way of the fine-stock outlet 8 is infed to the dynamic fine separator 2. By way of interaction with a rotatingly driven separation rotor 14, having guide blades 15, which is disposed in a (second) separation space 13, fine separation arises, wherein comparatively large particles of the fine stock 11, that is to say the medium-fine stock, is discharged from the second separation space 13 by way of a medium-fine stock outlet 16, while comparatively small particles, that is to say the finest stock, this in particular also potentially being a finished stock to be produced, flow away with the separation-gas flow by way of a finest-stock outlet 17.

The static coarse separator 1 is provided with two bypass ducts 18 which are integrated in the (part-) housing 3 of the coarse separator 1 and which are provided for directing part-flows of the total flow of the separation gas which enters the separator by way of the separator-gas inlet 5 in a regulatable manner past the first separation space 4, on account of which these part-flows do not participate in the coarse separation taking place in the first separation space 4. The two bypass ducts 18 are disposed on two opposite sides of the first separation space 4 and of the fine-stock outlet 8, having rectangular cross sections. Herein, external walls of the housing 3 encompass the bypass ducts 18 as well as the separation space 4 and the fine-stock outlet 8, while keeping apart in spatial terms the bypass ducts 18 on the one hand, and the separation space 4 as well as the fine-stock outlet 8, on the other hand, is implemented by way of two partition walls 19.

The partition walls 19 here are embodied so as to be extended upstream of the first separation space 4 (cf. FIG. 4), thereby protruding into the separation-gas inlet 5. On account thereof, separation of the part-flows of the separation gas which are directed by way of the bypass ducts 18 from the main flow which is directed by way of the first separation space 4 is implemented at a comparatively large spacing (upstream) from the ventilation base 9. On account thereof, it can be avoided as far as possible that diverting the part-flows has a negative influence on the perfusion of the ventilation base 9 by means of the main flow.

Figure 4:
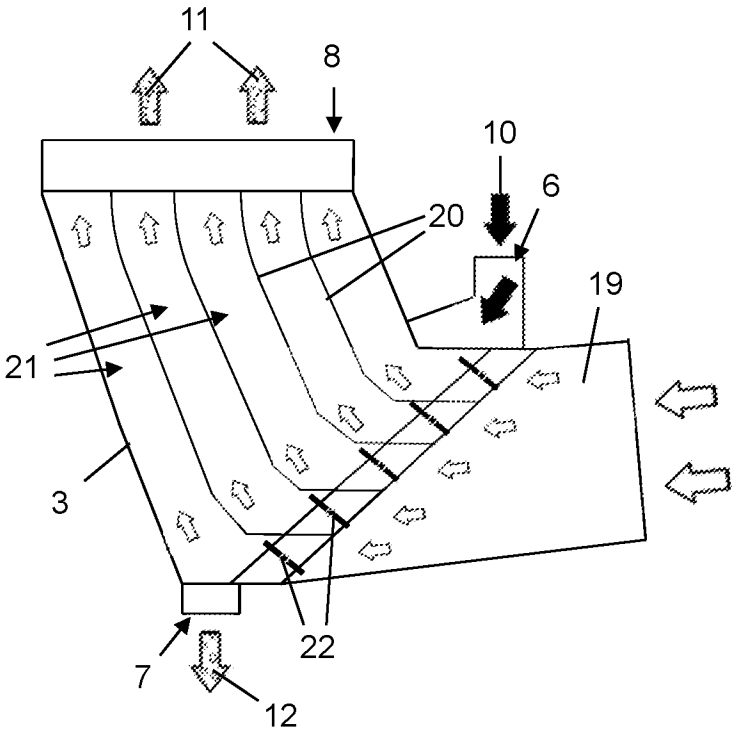
FIG. 4 is a sectional view taken across line IV-IV of the static coarse separator of FIG. 2.
Figure 6:
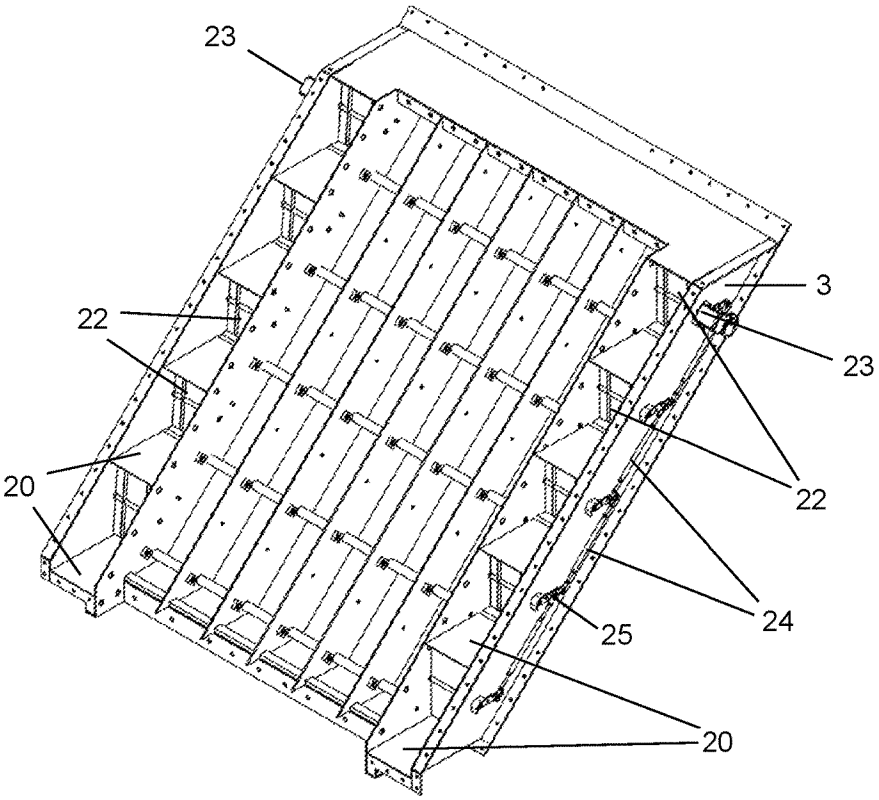
FIG. 6 is a perspective view of a part of an example static coarse separator that integrates regulator elements for regulating part-flows of a separation gas that are directed by way of bypass ducts.
Figure 8:
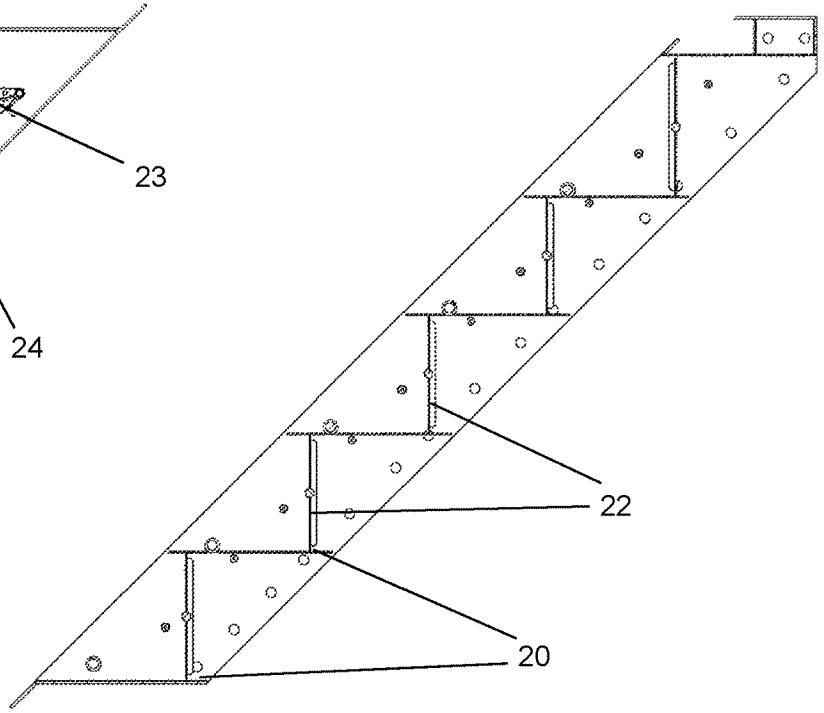
FIG. 8 is a cross-sectional view through a part of the static coarse separator shown in FIG. 6.
Figure 7:
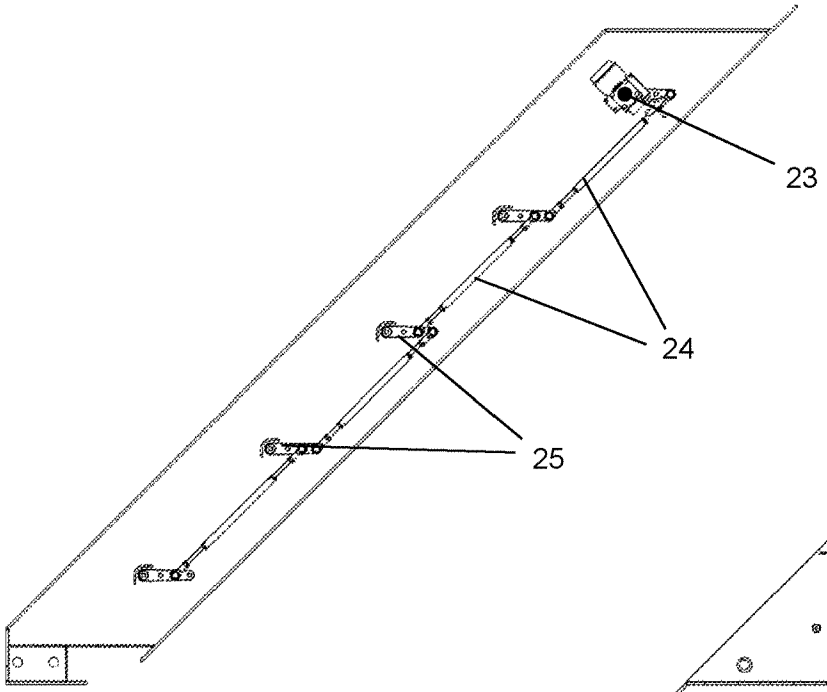
FIG. 7 is a side view of the part of the example static coarse separator shown in FIG. 6.

The diverted part-flows within the bypass ducts 18 are directed in a plurality of flow ducts 21 which run in parallel and which in spatial terms are kept apart by means of sub-partition walls 20. Herein, each flow duct 21 at the entry side is assigned in each case one regulator element in the form of a regulator flap 22 which is rotatable by approx. 90° about a shaft. The volumetric flow of the part-flows of the separation gas which is directed by way of the bypass ducts 18 is regulatable by the regulator flaps 22 between a minimal value which is present in the case of fully closed regulator flaps 22 and which is essentially zero, and a maximum value in the case of fully opened regulator flaps 22. FIGS. 6 and 8 show the regulator flaps 22 in the fully closed position, while a partially opened position of the regulator flaps 22 is shown in FIG. 4.

Adjustment of the regulator flaps 22 is performed in each case by means of one actuator 23 for each bypass duct, which in each case acts directly on the shaft of one of the regulator flaps 22, rotation of this one regulator flap 22 being transmitted by way of push-pull rods 24 and levers 25 to the other regulator flaps 22 of the respective bypass duct 18.

Figure 9:
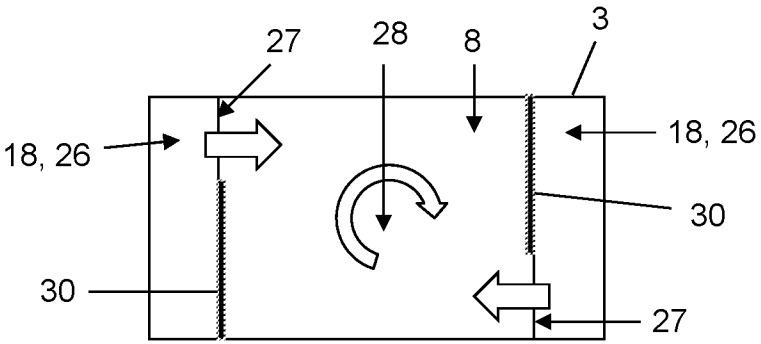
FIG. 9 is a schematic view illustrating generation of a swirl of a separation-gas flow in an example fine-stock outlet.

The partition walls 19 which keep the bypass ducts 18 apart from the first separation space 4 and the respective part of the fine-stock outlet 8 terminate so as to be approximately level with the sub-partition walls 20 which subdivide the bypass ducts 18 into the flow ducts 21. Downstream thereof, the housing configures in each case on outlet space 26 as part of the bypass ducts 18 (cf. FIG. 5). The part-flows which are directed in the individual flow ducts 21 of the bypass ducts 18 are collected in these outlet spaces 26, and then enter the fine-stock outlet 8 in each case by way of a port opening 27 which extends only across part of the respective side of the fine-stock outlet 8. It is provided here that the two port openings 27 of the two bypass ducts 18 in relation to a longitudinal central axis 28 of the fine-stock outlet 8 each are disposed in a decentralized and in a mutually diametrical manner (cf. FIG. 9; in FIG. 5 the respective apertures 30 for partially keeping the outlet spaces 26 apart in spatial terms from the fine-stock outlet 8 are not shown). On account thereof, the part-flows which enter from the bypass ducts 18 into the fine-stock outlet 8 cause a swirl of the then reunited total flow of the separation gas about the longitudinal central axis 28 of the fine-stock outlet 8. Herein, the rotation direction of the swirl corresponds to the rotation direction of the separation rotor 14 of the dynamic fine separator 2.

Figure 5:
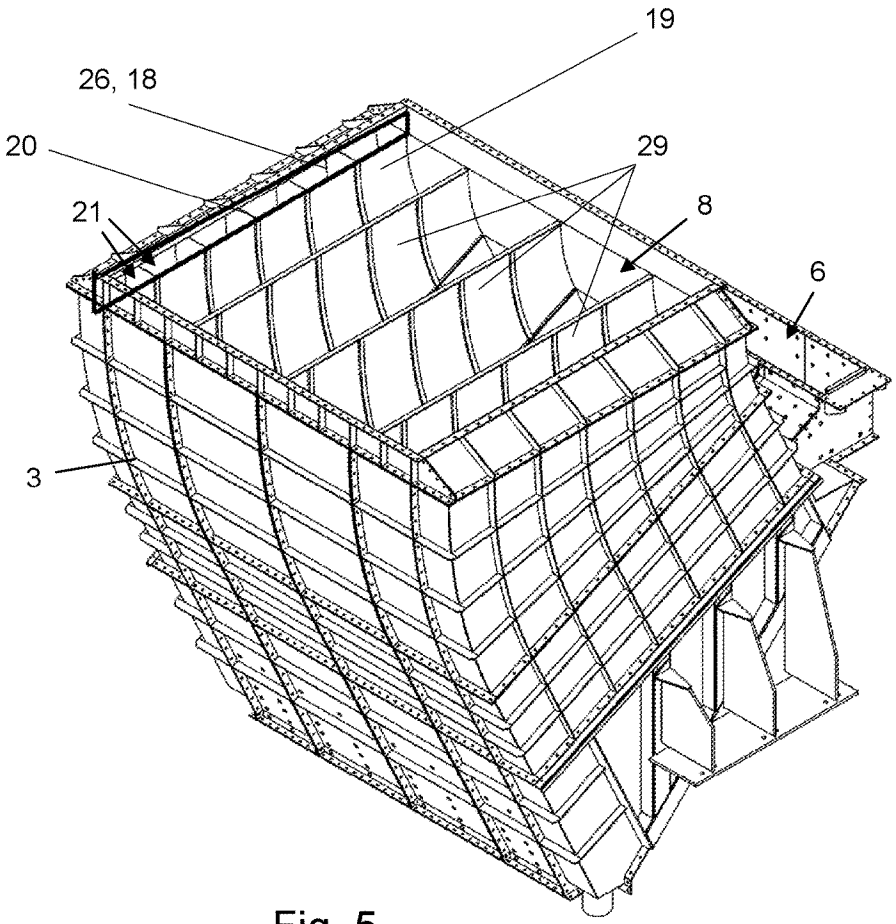
FIG. 5 is a perspective view of a part of an example static coarse separator that configures a separation space and an example fine-stock outlet.

It can also be seen in FIG. 5 that the fine-stock outlet 8 is subdivided into part-spaces by a plurality (presently three) intermediate walls 29, wherein the intermediate walls 29 are aligned transversely and in particular perpendicularly to the ventilation base 9. The intermediate walls 29 serve for reinforcing the housing 3, on the one hand, and on the other hand for increasing by means of an increase in the Froude number the load capacity of the main flow of the separation gas which has been reduced as a result of an optional diversion of the part-streams which have been directed by way of the bypass ducts 18. The intermediate walls 29 terminate downstream, approximately level with the partition walls 19 and with the sub-partition walls 20, and thus upstream of the port openings 27 of the bypass ducts 18. On account thereof, the former impede as little as possible the mixing of the part-flows which exit from the bypass ducts 18 with the main flow of the separation gas and the formation of a swirl performed thereby about the longitudinal central axis 28 of the fine-stock outlet 8.

Figure 2:
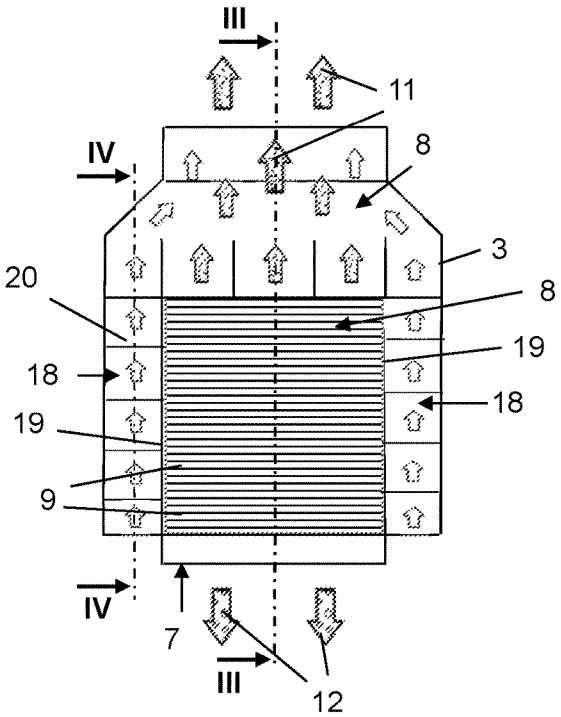
FIG. 2 is a front schematic view of an example static coarse separator.
Figure 10:
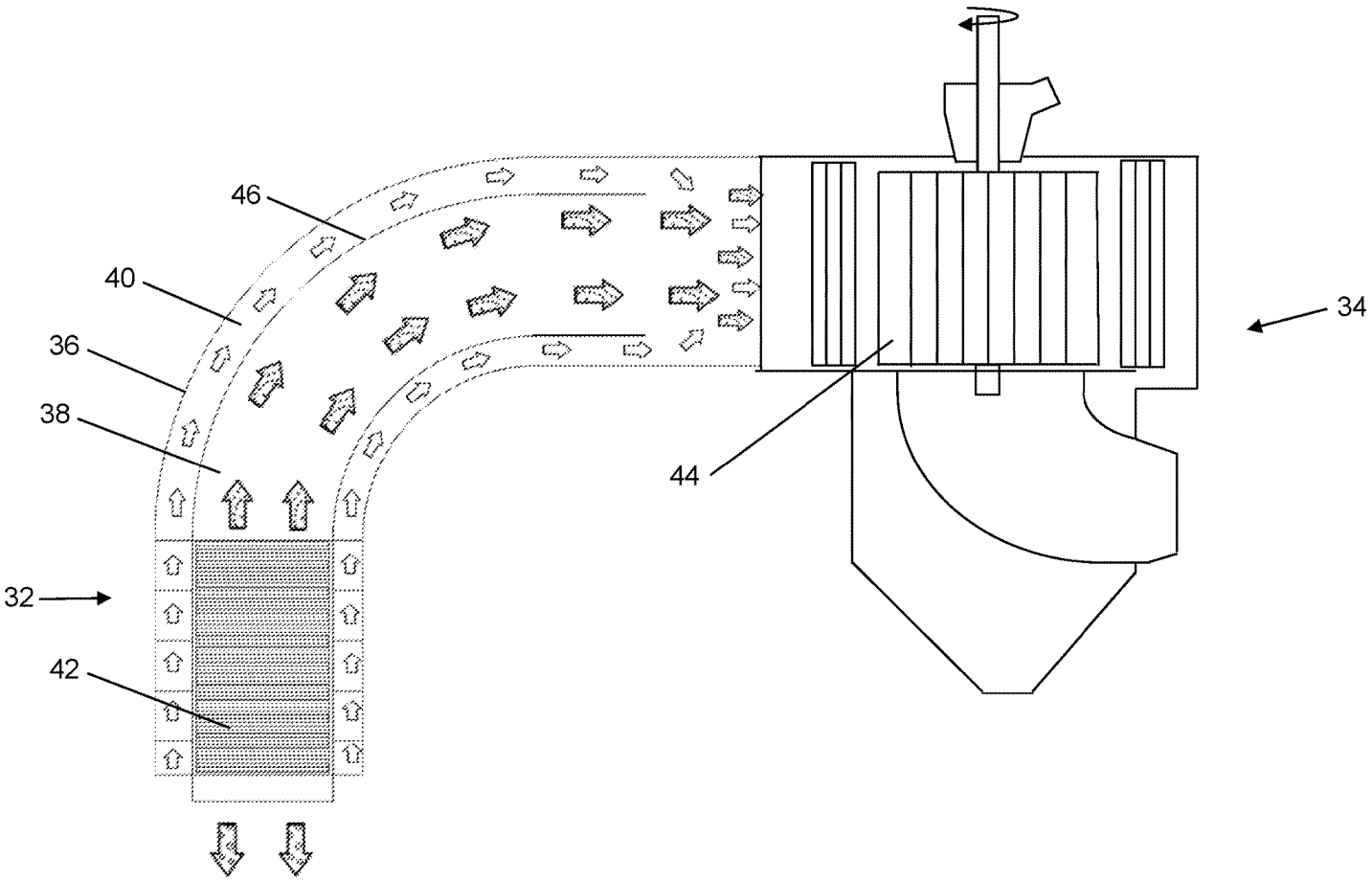
FIG. 10 is a front schematic view of an example separator, which includes an example static coarse separator and an example dynamic fine separator.

FIG. 10 shows a separator according to a further exemplary embodiment. The separator has a static coarse separator 32 and a dynamic fine separator 34 downstream thereof. The static coarse separator 32 is illustrated in a front view and corresponds substantially to the static coarse separator 1 illustrated in FIG. 2, having a ventilation base 42. As opposed to the static separator 1 illustrated in FIG. 2, the static coarse separator 32 shown in FIG. 10 has a housing 36 which may be configured so as to be tubular or to have a rectangular cross section, for example, serving as a connection piece between the ventilation base 42 and the fine-stock outlet. Two bypass ducts 40 by way of the which part-flows of the total flow entering the static separator 32 are directed past the ventilation base 42 and the first separation space 38 in a regulatable manner are disposed around the separation space 38 and within the housing 36. In the exemplary embodiment of the separator illustrated in FIG. 10, the housing 36 extends in an arcuate manner up to a dynamic separator 34 which adjoins the static separator 36, so that the flow perfusing the static separator 32 is deflected by approx. 180°, flowing into the dynamic separator 34. Keeping apart in spatial terms the separation space 38, or the fine-stock outlet of the static separator 34, respectively, and the bypass ducts 40 is implemented by partition walls 46. The partition walls 46 extend along the housing 36 of the static separator 32. That region of the static separator in which no further material separation is carried out adjoins the separation space 38 of the static separator. The partition walls 46 of the bypass ducts 40 in FIG. 10 extend across the length of the separation space 38 and across the length of the housing 36 in which sorting of coarse stock is performed. The partition walls 46 terminate in the fine-stock outlet which adjoins the separation space 38, and the bypass flow and the separated fine-stock flow are collected there and enter the dynamic separator 34.

As opposed to the separator which above has been described with reference to FIGS. 1 to 9, the fine stock which leaves the static separator is supplied in a substantially horizontal manner to the dynamic separator 34, at the level with the separation rotor 44.

Figure 11:
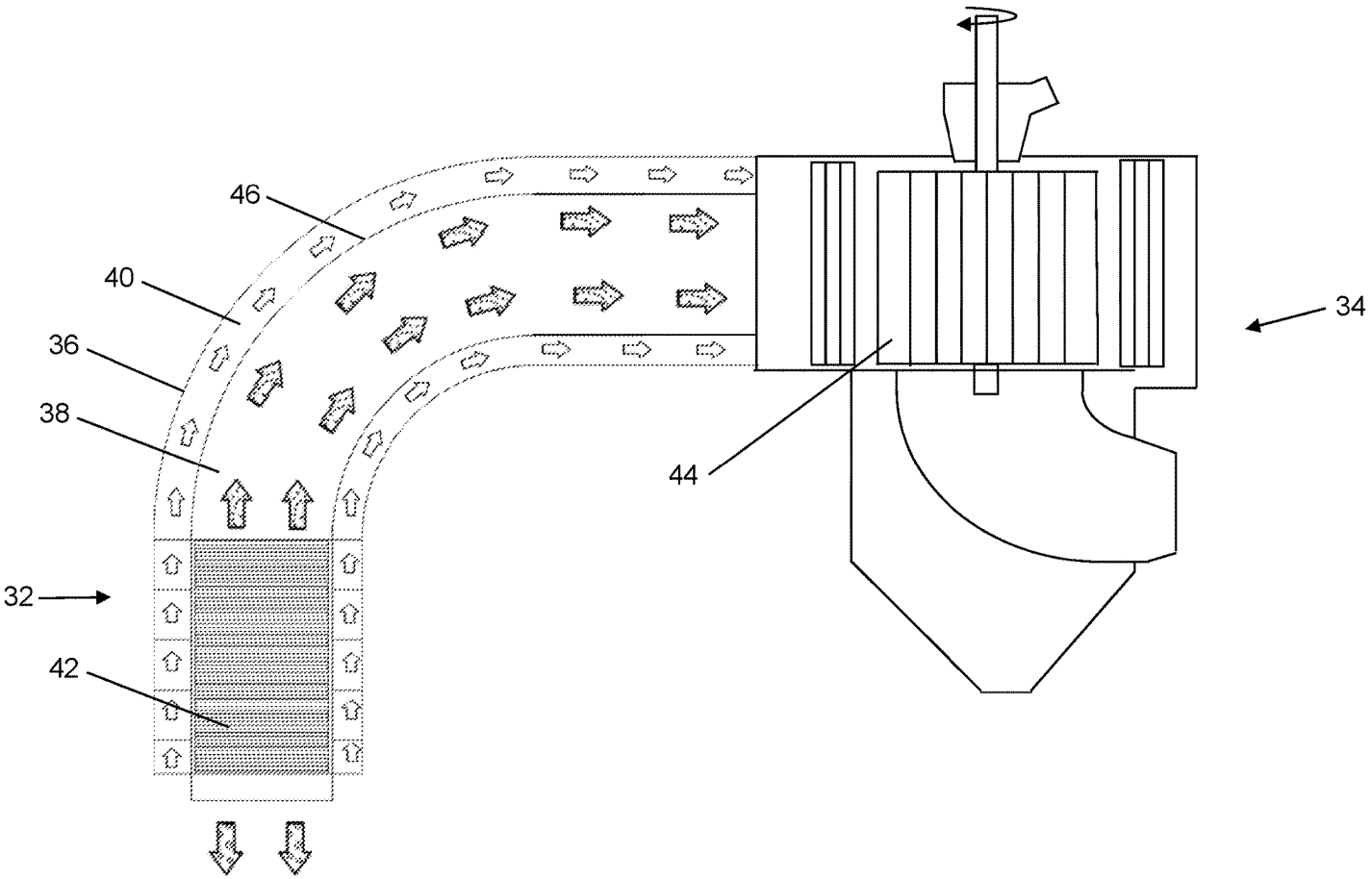
FIG. 11 is a front schematic view of another example separator including an example static coarse separator and an example dynamic fine separator.

FIG. 11 shows a separator according to a further exemplary embodiment. The separator illustrated in FIG. 11 corresponds substantially to the separator illustrated in FIG. 10, differing in that the partition wall 48 in FIG. 11 extends beyond the fine-stock outlet up to the inlet to the dynamic separator 34. The bypass flow and the separated fine-stock flow in the exemplary embodiment shown in FIG. 11 are collected downstream of the separation space 38 and downstream of the fine-stock outlet. The partition walls 48 terminate at the downstream end of the fine-stock outlet at the entry to the dynamic separator. It is likewise conceivable that the partition walls 48 extend somewhat into the gas entry of the dynamic separator 34.

What is claimed is:

1. A separator, comprising:

a housing defining, a first separation space in which a ventilation base is disposed and in which separation stock is perfusable by separation gas so as to separate the separation stock into fine stock and coarse stock, and a second separation space, wherein a portion of the housing surrounding the second separation space comprises a medium-fine stock outlet and a most-fine stock outlet;

a separation-gas inlet that opens into the first separation space;

a separation-stock inlet that opens into the first separation space;

a fine-stock outlet that leads out of the first separation space and adjoins the second separation space;

a coarse-stock outlet that leads out of the first separation space; and a bypass duct integrated in the housing for bypassing the first separation space, wherein the bypass duct leads out of the separation-gas inlet and opens out downstream of the separation space.

2. The separator of claim 1 wherein the bypass duct opens into an entry of a second separator that includes the second separation space.

3. The separator of claim 1 further comprising a rotatingly drivable separation rotor disposed in the second separation space.

4. The separator of claim 1 wherein the bypass duct opens into the fine-stock outlet.

5. The separator of claim 1 further comprising a regulator element for varying a flow cross section of the bypass duct.

6. The separator of claim 1 wherein the bypass duct opens into the fine-stock outlet in a decentralized manner.

7. The separator of claim 1 further comprising an intermediate wall that is disposed in the fine-stock outlet and is transverse to the ventilation base.

8. The separator of claim 7 wherein the bypass duct opens into the fine-stock outlet downstream of the intermediate wall.

9. The separator of claim 1 wherein the bypass duct leads out of the separation-gas inlet at a point that is spaced apart from the ventilation base.

10. The separator of claim 1 further comprising a partition wall that extends the bypass duct into the separation-gas inlet.

11. The separator of claim 1 wherein the fine-stock outlet is an outlet of the separation space for the separation gas.

12. The separator of claim 1 wherein the separation stock, which is introduced into the separation space by way of the separation-stock inlet, is directed by gravity along the ventilation base to the coarse-stock outlet while being perfused by the separation gas, which flows through ventilation slots of the ventilation base.

13. A separator, comprising:

a housing with a separation space in which a ventilation base is disposed and in which separation stock is perfusable by separation gas so as to separate the separation stock into fine stock and coarse stock;

a separation-gas inlet that opens into the separation space;

a separation-stock inlet that opens into the separation space;

a fine-stock outlet that leads out of the separation space;

a coarse-stock outlet that leads out of the separation space; and a bypass duct integrated in the housing for bypassing the separation space, wherein the bypass duct leads out of the separation-gas inlet and opens out downstream of the separation space, and wherein the bypass duct comprises a plurality of flow ducts.

14. The separator of claim 13 wherein the plurality of flow ducts of the bypass duct terminate in the fine-stock outlet, with the fine-stock outlet being spaced apart from a port of the bypass duct.

15. The separator of claim 13 further comprising a regulator element for each of the plurality of flow ducts of the bypass duct, wherein each regulator element is configured to vary a flow cross section of a respective flow duct.

16. The separator of claim 15 wherein each of the regulator elements is individually adjustable.

17. The separator of claim 13 wherein the bypass duct is subdivided by sub-partition walls into the plurality of flow ducts.

18. A separator, comprising:

a housing with a separation space in which a ventilation base is disposed and in which separation stock is perfusable by separation gas so as to separate the separation stock into fine stock and coarse stock;

a separation-gas inlet that opens into the separation space;

a separation-stock inlet that opens into the separation space;

a fine-stock outlet that leads out of the separation space;

a coarse-stock outlet that leads out of the separation space;

a first bypass duct integrated in the housing for bypassing the separation space, wherein the bypass duct leads out of the separation-gas inlet and opens out downstream of the separation space; and a second bypass duct, wherein, relative to a longitudinal central axis of the fine-stock outlet, the first and second bypass ducts open into the fine-stock outlet in a decentralized and diametrical manner.

* * * * *